US008548691B2

(12) United States Patent
Hayashi et al.

(10) Patent No.: US 8,548,691 B2
(45) Date of Patent: Oct. 1, 2013

(54) BLADE CONTROL SYSTEM, CONSTRUCTION MACHINE AND BLADE CONTROL METHOD

(75) Inventors: Kazuhiko Hayashi, Komatsu (JP); Kenjiro Shimada, Komatsu (JP); Kenji Okamoto, Hiratsuka (JP)

(73) Assignee: Komatsu Ltd., Tokyo (JP)

( * ) Notice: Subject to any disclaimer, the term of this patent is extended or adjusted under 35 U.S.C. 154(b) by 113 days.

(21) Appl. No.: 13/267,046

(22) Filed: Oct. 6, 2011

(65) Prior Publication Data

US 2013/0087350 A1 Apr. 11, 2013

(51) Int. Cl.
*E02F 3/76* (2006.01)
*G06F 7/70* (2006.01)

(52) U.S. Cl.
USPC ..... 701/50; 172/4.5

(58) Field of Classification Search
USPC ..... 37/347, 348, 414–417; 172/2–11, 172/430; 414/685, 699, 686, 722; 701/50, 701/36, 213
See application file for complete search history.

(56) References Cited

U.S. PATENT DOCUMENTS 5,621,643 A 4/1997 Nakagami et al.
5,950,141 A * 9/1999 Yamamoto et al. ..... 702/41
5,951,613 A 9/1999 Sahm et al.
6,068,060 A 5/2000 Ohtomo et al.
6,845,311 B1 * 1/2005 Stratton et al. ..... 701/50
8,082,084 B2 * 12/2011 Nichols ..... 701/50

FOREIGN PATENT DOCUMENTS

JP 5-106239 A 4/1993
JP 10-141955 A 5/1998
JP 10-147952 A 6/1998
JP 11-256620 A 9/1999
JP 3794763 B2 7/2006

OTHER PUBLICATIONS

International Search Report of corresponding PCT Application No. PCT/JP2012/073150 dated Dec. 18, 2012.

* cited by examiner

*Primary Examiner* — Robert Pezzuto
(74) *Attorney, Agent, or Firm* — Global IP Counselors, LLP

(57) ABSTRACT

A blade control system includes a first open ratio setting part for setting a first open ratio of a proportional control valve based on a difference angle between a blade angle and a slope angle; a second open ratio setting part for setting a second open ratio of the proportional control valve based on a difference load between a blade load and a target blade load; and a lift controlling part for controlling the proportional control valve in accordance with the second open ratio when the blade load is out of a predetermined load range and for controlling the proportional control valve in accordance with the first open ratio when the blade load is within the predetermined load range.

5 Claims, 9 Drawing Sheets

BLADE CONTROL SYSTEM, CONSTRUCTION MACHINE AND BLADE CONTROL METHOD

BACKGROUND

1. Technical Field

The present invention relates to a blade control system, a construction machine and a blade control method.

2. Description of the Related Art

Well-known dozing controls, having been proposed for the construction machines (e.g., the bulldozers and the motor graders), are intended to efficiently execute a dozing work and are configured to automatically regulate the vertical position of a blade for keeping load acting on the blade (hereinafter referred to as "blade load") at a target value (e.g., see Japan Laid-open Patent Application Publication No. JP-A-H05-106239.

SUMMARY

When an object for dozing (i.e., the ground), formed in a wavy contour, is dozed with the method described in the publication No. JP-A-H05-106239, however, the dozed surface of the object for dozing partially remains in a wavy contour even if a designed surface, indicating a target contour of the object for dozing, is flat.

The present invention has been produced in view of the above drawback and is intended to provide a blade control system, a construction machine and a blade control method for efficiently dozing and inhibiting a dozed surface from being formed in a wavy contour.

A blade control system according to a first aspect of the present invention includes a lift frame vertically pivotably attached to a vehicle body; a blade attached to a tip of the lift frame; a lift cylinder configured to vertically drive the lift frame; a control valve configured to supply a hydraulic oil to the lift cylinder; a blade angle calculating part configured to calculate sum of a forwardly inclined angle of the vehicle body with respect to a reference surface and a blade lifting angle of the lift frame with respect to a reference position; a slope angle obtaining part configured to calculate a slope angle of a designed surface with respect to the reference surface, the designed surface indicating a target contour of an object for dozing; a difference angle calculating part configured to calculate a difference angle between the blade angle and the slope angle; a first open ratio setting part configured to set a first open ratio of the control valve based on the difference angle; a blade load obtaining part configured to obtain a blade load acting on the blade; a difference load calculating part configured to calculate a difference load between the blade load and a target blade load; a second open ratio setting part configured to set a second open ratio of the control valve based on the difference load; and a lift controlling part configured to control the control valve based on the second open ratio when the blade load is out of a predetermined load range, and the lift controlling part configured to control the control valve in accordance with the first open ratio when the blade load is within the predetermined load range.

According to the blade control system of the first aspect of the present invention, a cutting edge of the blade can be moved along the designed surface when the blade load is kept roughly close to the target value, thereby the dozed surface can be inhibited from being formed in a wavy contour. On the other hand, the blade load can be promptly regulated to get closer to the target value when the blade load is deviated from the target value, thereby dozing can be thereby efficiently executed.

In a blade control system according to a second aspect of the present invention relating to the first aspect, when dozing is continuously executed from the designed surface to another designed surface continued to the designed surface, the lift controlling part is configured to regulate the blade lifting angle for making the sum to gradually get closer to a slope angle of another designed surface with respect to the reference surface.

According to the blade control system of the second aspect of the present invention, the blade lifting angle is regulated to gradually get closer to the slope angle of another designed surface when the target contour of the object for dozing is changed from the designed surface to another designed surface. Therefore, the dozed surface can be inhibited from being roughened due to abrupt change of the blade lifting angle, thereby the boundary between two dozed surfaces and its periphery can be inhibited from being formed in a wavy contour.

A construction machine according to a third aspect of the present invention includes a vehicle body and the blade control system according to the first or second aspect of the present invention.

A construction machine according to a fourth aspect of the present invention further includes a drive unit including a pair of tracks attached to the vehicle body.

A blade control method according to a fifth aspect of the present invention includes: regulating a blade lifting angle of a lift frame vertically pivotably attached to a vehicle body with respect a reference position for allowing a blade load acting on a blade attached to a tip of the lift frame to fall in a predetermined load range when the blade load is out of the predetermined load range; and regulating the blade lifting angle for allowing sum of the blade lifting angle of a inclined angle of the vehicle body with respect to a reference surface to fall in a predetermined angular range including a slope angle of a designed surface indicating a target contour of an object for dozing with respect to the reference surface when the blade load is within the predetermined load range.

BRIEF DESCRIPTION OF THE DRAWINGS

Referring now to the attached drawings which form a part of this original disclosure.

DETAILED DESCRIPTION OF THE EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

With reference to attached figures, a bulldozer will be hereinafter explained as an exemplary "construction machine". In the following explanation, the terms "up", "down", "front", "rear", "right" and "left" and their related terms should be understood as directions seen from an operator seated on an operator's seat.

Overall Structure of Bulldozer 100

Figure 1:
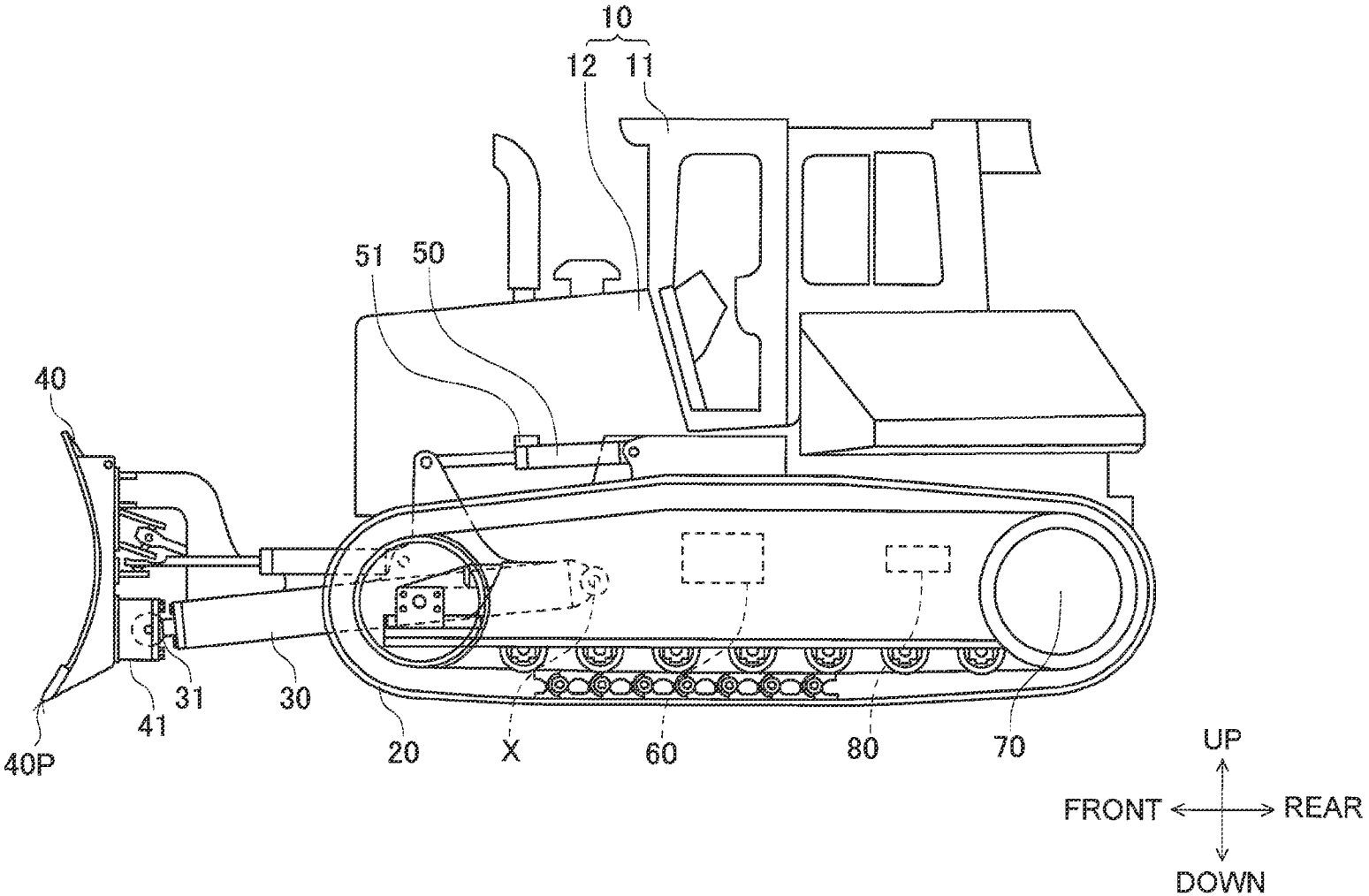
FIG. 1 is a side view of the entire structure of a bulldozer.

FIG. 1 is a side view of the entire structure of a bulldozer 100 according to an exemplary embodiment of the present invention.

The bulldozer 100 includes a vehicle body 10, a drive unit 20, a lift frame 30, a blade 40, a lift cylinder 50, an IMU (Inertial Measurement Unit) 60, a pair of sprocket wheels 70 and a driving torque sensor 80. Further, the bulldozer 100 is embedded with a blade control system 200. The structure and actions of the blade control system 200 will be hereinafter described.

The vehicle body 10 includes a cab 11 and an engine compartment 12. Although not illustrated in the figures, the cab 11 is equipped with a seat and a variety of operating devices. The engine compartment 12 is disposed forwards of the cab 11 for accommodating an engine (not illustrated in the figures).

The drive unit 20 is formed by a pair of tracks (only the left-side one is illustrated in FIG. 1), and the drive unit 20 is attached to the bottom of the vehicle body 10. The drive unit 20 is configured to be rotated by the pair of sprocket wheels 70.

The lift frame 30 is disposed inwards of the drive unit 20 in the right-and-left direction of the bulldozer 100. The lift frame 30 is attached to the vehicle body 10 while being up-and-down directionally pivotable about an axis X arranged in parallel to the right-and-left direction of the bulldozer 100. The lift frame 30 supports the blade 40 through a ball-and-socket joint 31.

The blade 40 is disposed forwards of the vehicle body 10. The blade 40 is supported by the lift frame 30 through a universal coupling 41 coupled to the ball-and-socket joint 31. The blade 40 is configured to be lifted up or down in conjunction with upward or downward pivot of the lift frame 30. The blade 40 includes a cutting edge 40P on the bottom end thereof The cutting edge 40P is shoved into the ground in dozing or grading.

The lift cylinder 50 is coupled to the vehicle body 10 and the lift frame 30. In conjunction with extension or contraction of the lift cylinder 50, the lift frame 30 is configured to pivot up and down about the axis X. The lift cylinder 50 includes a lift cylinder sensor 51 which is configured to detect the stroke length of the lift cylinder 50 (hereinafter referred to as "a lift cylinder length L"). Although not illustrated in the figures, the lift cylinder sensor 51 is formed by a rotatable roller which is configured to detect the position of a cylinder rod and a magnetic sensor which is configured to return the cylinder rod to the original position. The lift cylinder sensor 51 is configured to inform a blade controller 210 to be described (see FIG. 2) of the lift cylinder length L.

The IMU 60 is configured to obtain vehicle body tilting angle data indicating vehicle body tilting angles in the longitudinal and right-and-left directions. The IMU 60 is configured to transmit the obtained vehicle body tilting angle data to the blade controller 210 to be described.

The pair of sprocket wheels 70 is configured to be driven by the engine accommodated in the engine compartment 12. The drive unit 20 is configured to be rotated in conjunction with driving of the pair of sprocket wheels 70.

The driving torque sensor 80 is configured to obtain driving toque data indicating driving torque of the pair of sprocket wheels 70. The driving torque sensor 80 is configured to transmit the obtained driving torque data to the blade controller 210.

Structure of Blade Control System 200

Figure 2:
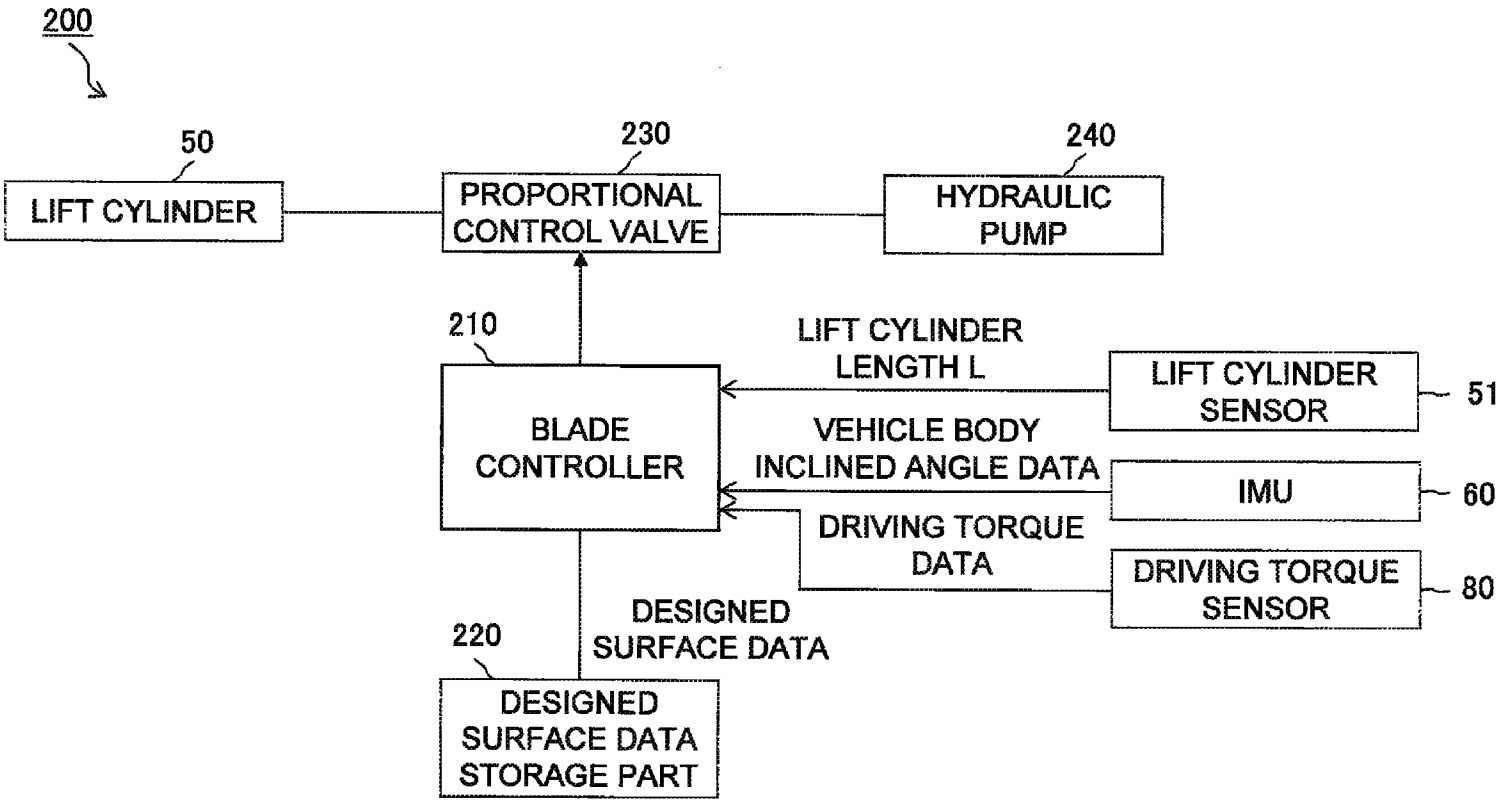
FIG. 2 is a configuration block diagram of a blade control system.

FIG. 2 is a configuration block diagram of the blade control system 200 according to the present exemplary embodiment. As represented in FIG. 2, the blade control system 200 includes the blade controller 210, a designed surface data storing part 220, a proportional control valve 230 and a hydraulic pump 240.

Figure 4:
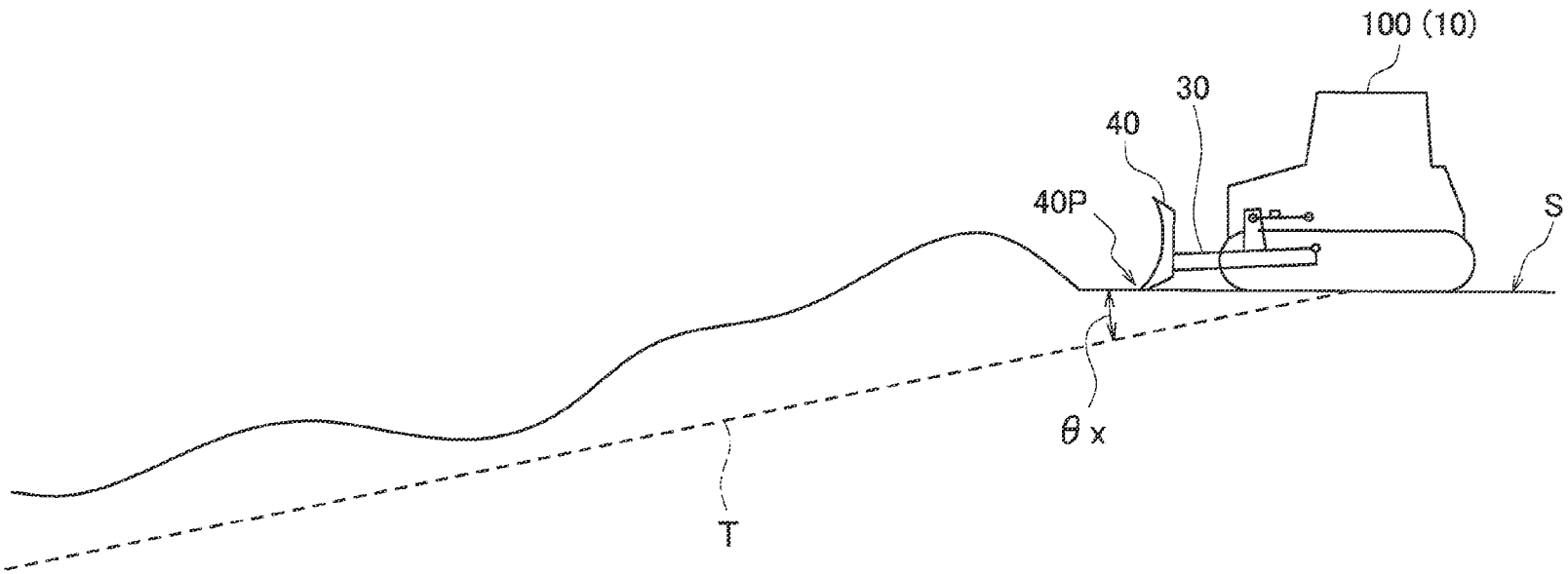
FIG. 4 is a schematic diagram illustrating a state of the bulldozer before onset of dozing.
Figure 5:
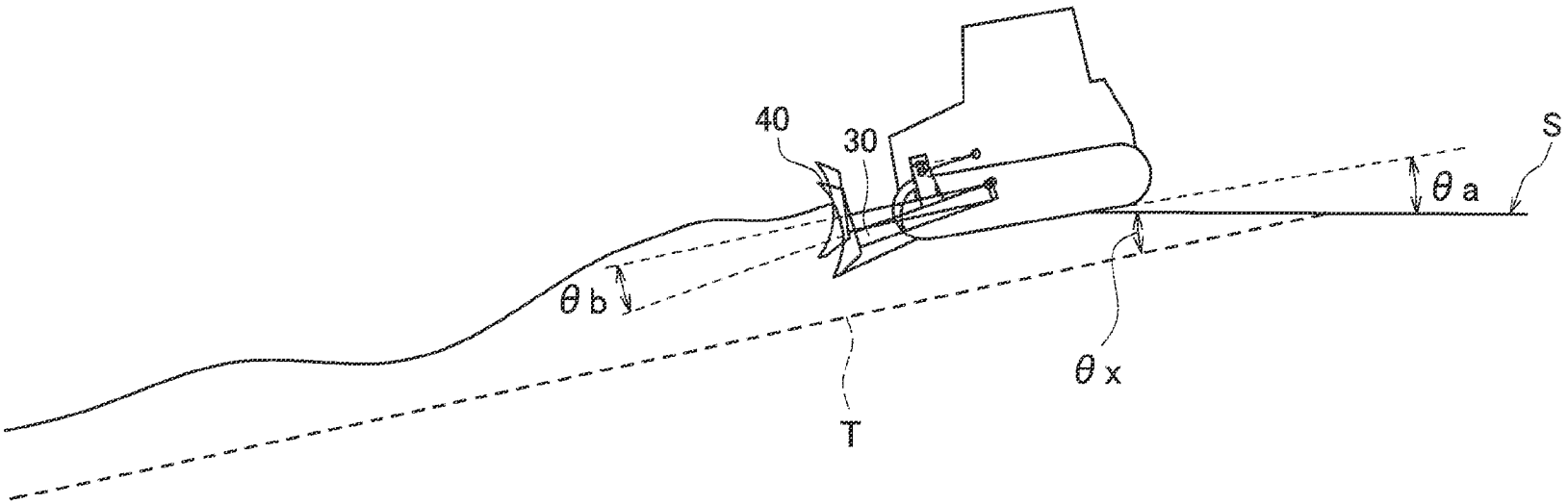
FIG. 5 is a schematic diagram illustrating a state of the bulldozer after the onset of dozing.

The designed surface data storing part 220 has been preliminarily stored designed surface data indicating a position and a shape of a designed surface T to be described (see FIGS. 4 and 5).

The blade controller 210 is configured to output a command value to the proportional control valve 230 based on the lift cylinder length L received from the lift cylinder sensor 51, the vehicle body inclined angle data received from the IMU 60, the driving torque data received from a driving torque sensor 80, the designed surface data stored in the designed surface data storing part 220. Functions and actions of the blade controller 210 will be hereinafter described.

The proportional control valve 230 is disposed between the lift cylinder 50 and the hydraulic pump 240. The open ratio of the proportional control valve 230 is configured to be controlled by the command value outputted from the blade controller 210.

The hydraulic pump 240 is configured to be operated in conjunction with the engine, and is configured to supply hydraulic oil to the lift cylinder 50 via the proportional control valve 230. It should be noted that the amount of the hydraulic oil to be supplied from the hydraulic pump 240 to the lift cylinder 50 is determined in accordance with the open ratio of the proportional control valve 230.

Functions of Blade Controller 210

Figure 3:
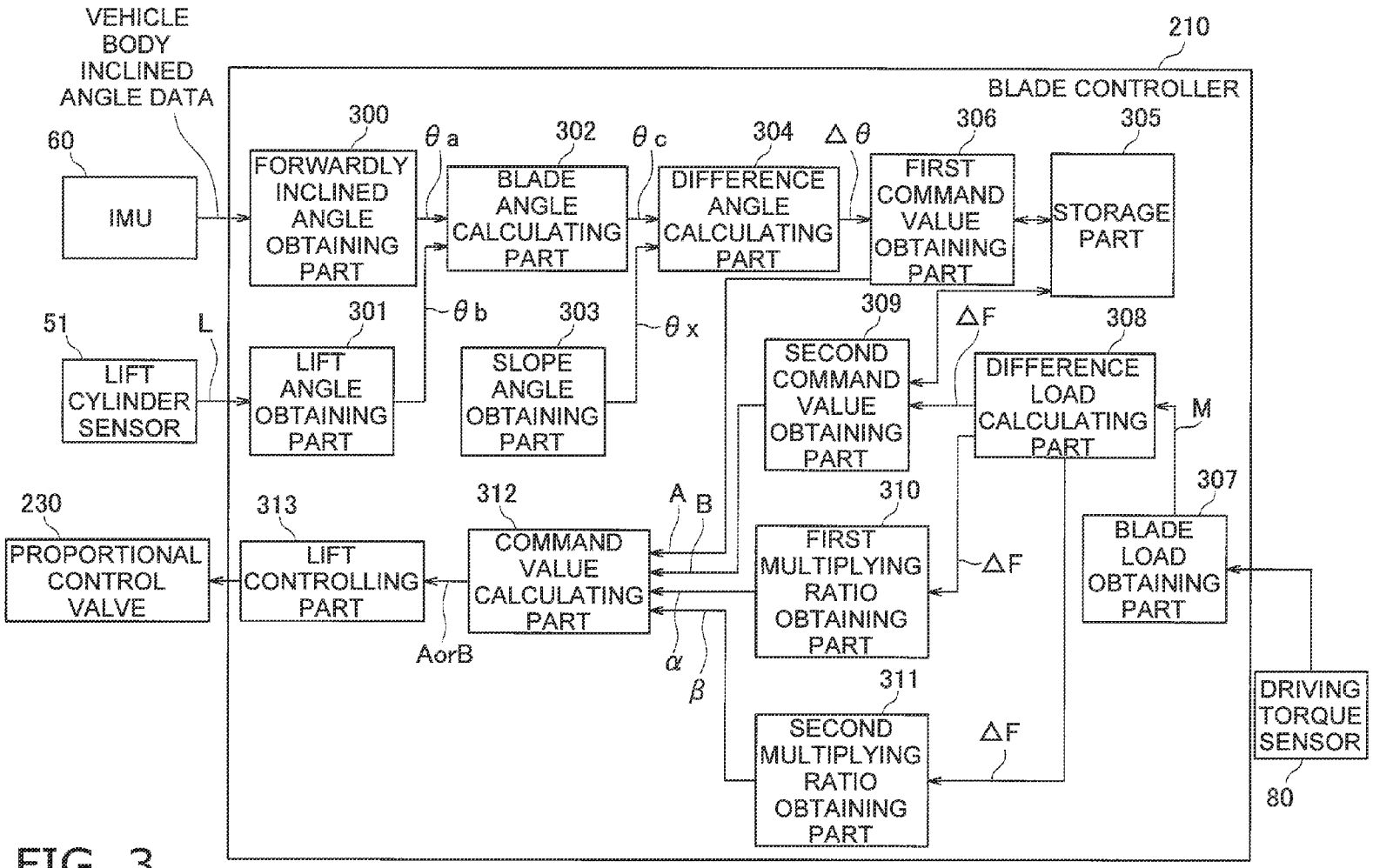
FIG. 3 is a functional block diagram of a blade controller.

FIG. 3 is a functional block diagram of the blade controller 210. FIGS. 4 and 5 are schematic diagrams illustrating time-series conditions of the bulldozer 100 currently executing a dozing work. In FIGS. 4 and 5, the bulldozer 100 is dozing a reference surface S with the blade 40 for creating the designed surface T. The designed surface T herein refers to a designed landform indicating a target contour of an object for dozing within a work area.

As represented in FIG. 3, the blade controller 210 includes a forwardly inclined angle obtaining part 300, a blade lifting angle obtaining part 301, a blade angle calculating part 302, a slope angle obtaining part 303, a difference angle calculating part 304, a storage part 305, a first command value obtaining part 306, a blade load obtaining part 307, a difference load calculating part 308, a second command value obtaining part 309, a first multiplying ratio obtaining part 310, a second multiplying ratio obtaining part 311, a command value calculating part 312 and a lift controlling part 313.

The forwardly inclined angle obtaining part 300 is configured to calculate a forwardly inclined angle θa of the vehicle body 10 with respect to the reference surface S based on the vehicle body inclined angle data received from the IMU 60. For example, the reference surface S may be set as a horizontal surface, or alternatively, set as the ground on which the bulldozer 100 is positioned in actually starting dozing. In starting dozing and entering a dozed slope from the reference surface S, the bulldozer 100 is inclined when the center of inertia of the bulldozer 100 gets across a dozing starting point as illustrated in FIG. 5. The forwardly inclined angle obtaining part 300 is configured to obtain the forwardly inclined angle θa of the vehicle body 10 at this point.

The blade lifting angle obtaining part 301 is configured to calculate a blade lifting angle θb of the blade 40 illustrated in FIG. 5 based on the lift cylinder length L received from the lift cylinder sensor 51. As illustrated in FIG. 5, the blade lifting angle θb corresponds to a downward angle from a reference position of the lift frame 30, i.e., the depth of the cutting edge 40P shoved into the ground. In FIG. 5, "the reference position" of the lift frame 30 is depicted with a dashed dotted line, while "a present position" of the lift frame 30 is depicted with a solid line. The reference position of the lift frame 30 herein refers to the position of the lift frame 30 under the condition that the cutting edge 40P makes contact with the reference surface S.

Figure 6:
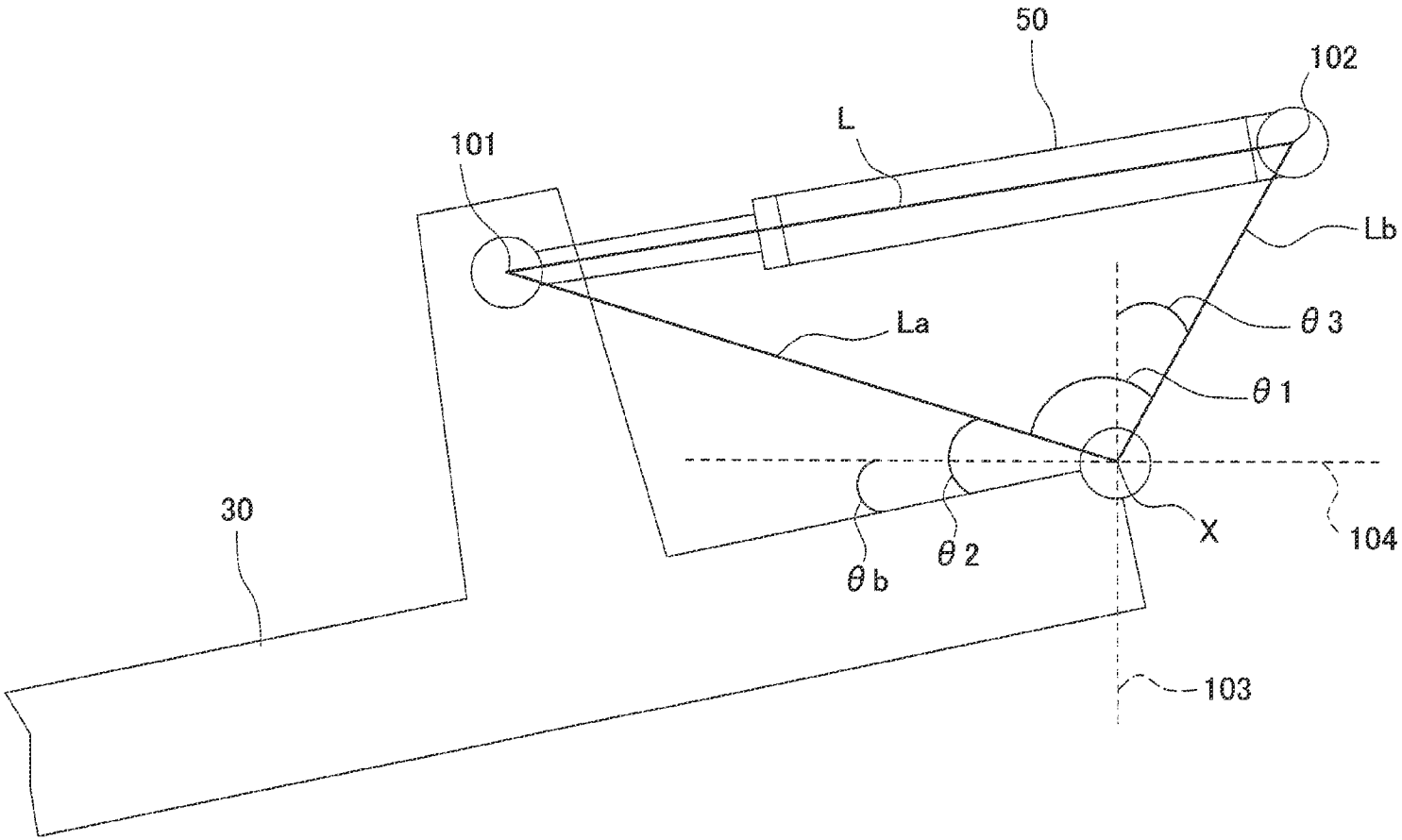
FIG. 6 is a partially enlarged view of FIG. 5.

Now, FIG. 6 is a partially enlarged view of FIG. 5 and schematically explains a method of calculating the blade lifting angle θb. As illustrated in FIG. 6, the lift cylinder 50 is attached to the lift frame 30 while being rotatable about a front-side rotary axis 101, and is attached to the vehicle body 10 while being rotatable about a rear-side rotary axis 102. FIG. 6 depicts a vertical line 103 which is a straight line arranged along the vertical direction, and an original position indicating line 104 which is a straight line indicating the original position of the blade 40. Further, a first length La is the length of a straight line segment connecting the front-side rotary axis 101 and an axis X of the lift frame 30, whereas a second length Lb is the length of a straight line segment connecting the rear-side rotary axis 102 and the axis X of the lift frame 30. Further, a first angle $\theta_1$ is formed between the front-side rotary axis 101 and the rear-side rotary axis 102 around the axis X as the vertex of the first angle $\theta_1$, and a second angle $\theta_2$ is formed between and the front-side rotary axis 101 and the upper face of the lift frame 30 around the axis X as the vertex of the first angle $\theta_2$, and a third angle $\theta_3$ is formed between the rear-side rotary axis 102 and the vertical line 103 around the axis X as the vertex of the first angle $\theta_3$. The first length La, the second length Lb, the second angle $\theta_2$ and the third angle $\theta_3$ are fixed values and are stored in the angle obtaining part 210. Radian is herein set as the unit for the second angle $\theta_2$ and that of the third angle $\theta_3$.

First, the blade lifting angle obtaining part 301 is configured to calculate the first angle $\theta_1$ using the following equations (1) and (2) based on the law of cosines.

$$L^2=La^2+Lb^2-2LaLb\times\cos(\theta_1) \quad (1)$$

$$\theta_1=\cos^{-1}((La^2+Lb^2-L^2)/2LaLb) \quad (2)$$

Next, the blade lifting angle obtaining part 301 is configured to calculate the blade lifting angle θb using the following equation (3).

$$\theta b=\theta_1+\theta_2-\theta_3-\pi/2 \quad (3)$$

The blade angle calculating part 302 is configured to calculate sum of the forwardly inclined angle θa of the vehicle body 10 and the blade lifting angle θb of the lift frame 30 (hereinafter referred to as "a blade angle θc"). In other words, the relation "θc=θa+θb" is established, and the blade angle θc is the blade lifting angle of the blade 40 with respect to the reference surface S.

The slope angle obtaining part 303 is configured to calculate a slope angle θx of the designed surface T with respect to the reference surface S.

The difference angle calculating part 304 is configured to calculate a difference angle Δθ between the blade angle θc and the slope angle θx.

The storage part 305 stores a variety of maps used for controls by the blade controller 210. Specifically, the storage part 305 stores a gain curve Y1 represented in FIG. 7. The gain curve Y1 defines a relation between the difference angle Δθ and a first command value A (an elevating command value or a lowering command value). Further, the storage part 305 stores a gain curve Y2 represented in FIG. 8. The gain curve Y2 defines a relation between a difference load ΔF and a second command value B (an elevating command value or a lowering command value). Further, the storage part 305 stores a multiplying ratio curve G1 represented in FIG. 9. The multiplying ratio curve G1 defines a relation between the difference load ΔF and a first multiplying ratio α. Yet further, the storage part 305 stores a multiplying ratio curve G2 represented in FIG. 10. The multiplying ratio curve G2 defines a relation between the difference load ΔF and a second multiplying ratio β.

Figure 7:
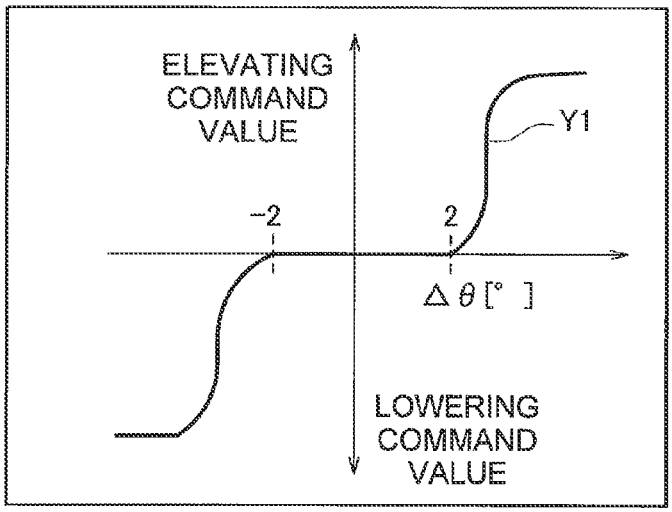
FIG. 7 is a map representing relation between difference angle and first command value.

The first command value obtaining part 306 (an exemplary first open ratio setting part) is configured to obtain the first command value A (the elevating command value or the lowering command value) based on the difference angle Δθ with reference to the gain curve Y1 represented in FIG. 7. The first command value A corresponds to the open ratio of the proportional control valve 230. As is obvious from the gain curve Y1 in FIG. 7, the first command value obtaining part 306 is configured to set the first command value A to be the elevating command value when the difference angle Δθ is greater than or equal to 2 degrees, whereas the first command value obtaining part 306 is configured to set the first command value A to be the lowering command value when the difference angle Δθ is less than or equal to −2 degrees. This indicates that the lift control is executed for allowing the blade angle θc to fall in a range of ±2 degrees. It should be noted that the angular range for setting the first command value A to be "0" may not be limited to a range of ±2 degrees and may be arbitrarily set.

The blade load obtaining part 307 is configured to calculate a load acting on the blade 40 (hereinafter referred to as "a blade load M") based on the driving torque data obtained from the driving torque sensor 80. The blade load can be referred to as either "dozing resistance" or "traction force".

The difference load calculating part 308 is configured to calculate the difference load ΔF between the blade load M and a target blade load N. The target blade load N is an optimum value of actually measured load (i.e., the blade load M). The target blade load N can achieve both increase in the dozing amount and inhibition of excessive shoe slippage in the drive unit 20. For example, the target blade load N is set to be 0.6 W ("W" herein refers to the vehicle weight of the bulldozer 100). The more the blade load M gets closer to the target load N, the higher chances are that the dozing amount is increased and simultaneously excessive shoe slippage is inhibited in the drive unit 20. It should be noted that shoe slippage is caused even in the normal operation, but the amount of slippage is excessively increased and driving force of the drive unit 20 cannot be appropriately transferred to the ground when excessive shoe slippage is caused.

Figure 8:
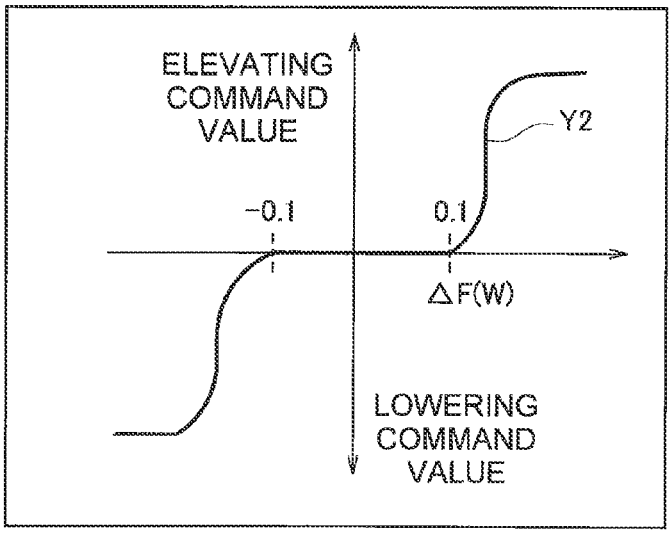
FIG. 8 is a map representing relation between difference load and second command value.

The second command value obtaining part 309 (an exemplary second open ratio setting part) is configured to obtain the second command value B (the elevating command value or the lowering command value) based on the difference load ΔF with reference to the gain curve Y2 represented in FIG. 8. The second command value B corresponds to the open ratio of the proportional control valve 230. As is obvious from the gain curve Y2 in FIG. 8, the second command value obtaining part 309 is configured to set the second command value B to be the elevating command value when the difference load ΔF is greater than or equal to 0.1 W, whereas the second command value obtaining part 309 is configured to set the second command value B to be the lowering command value when the difference load ΔF is less than or equal to −0.1 W. This indicates that the lift control is executed for allowing the blade load M to fall in a range of ±0.1 W. It should be noted that the load range for setting the second command value B to be "0" may not be limited to a range of ±0.1 W and may be arbitrarily set.

Figure 9:
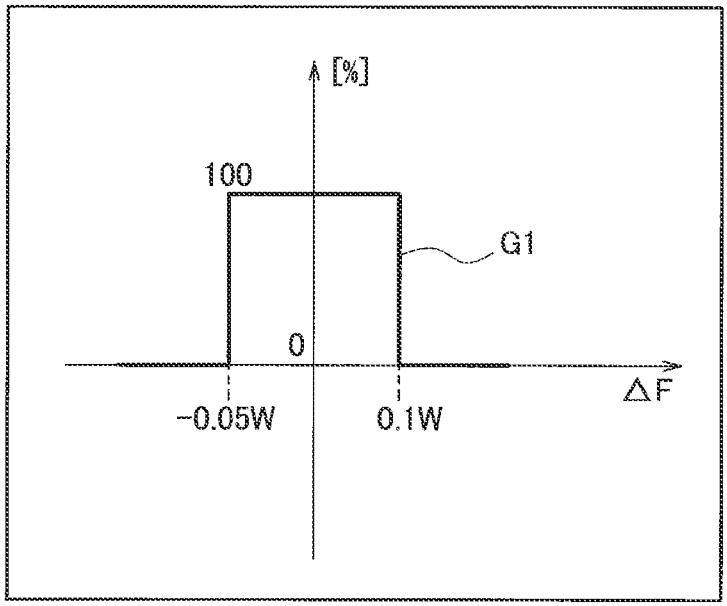
FIG. 9 is a map representing relation between difference load and first multiple ratio.

The first multiplying ratio obtaining part 310 is configured to obtain the first multiplying ratio a based on the difference load ΔF with reference to the multiplying ratio curve G1 represented in FIG. 9. As is obvious from the multiplying ratio curve G1, the first multiplying ratio α is set to be "0" where the difference load ΔF is out of a predetermined load range (i.e., where the difference load ΔF is less than −0.05 W or greater than 0.1 W). On the other hand, the first multiplying ratio α is set to be "1" where the difference load ΔF falls in the predetermined load range (i.e., where the difference load ΔF is greater than or equal to −0.05 W and less than or equal to 0.1 W).

Figure 10:
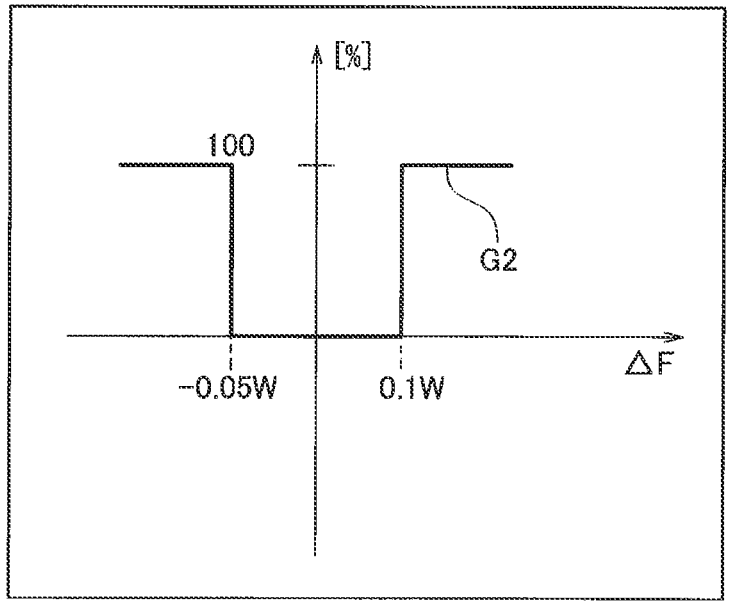
FIG. 10 is a map representing relation between difference load and second multiple ratio.

The second multiplying ratio obtaining part 311 is configured to obtain the second multiplying ratio β based on the difference load ΔF with reference to the multiplying ratio curve G2 represented in FIG. 10. As is obvious from the multiplying ratio curve G2, the second multiplying ratio β is set to be "1" where the difference load ΔF is out of a predetermined load range (i.e., where the difference load ΔF is less than −0.05 W or greater than 0.1 W), whereas the second multiplying ratio β is set to be "0" where the difference load ΔF falls in the predetermined load range (i.e., where the second multiplying ratio β is greater than or equal to −0.05 W and less than or equal to 0.1 W).

The command value calculating part 312 is configured to multiply the first command value A by the first multiplying ratio a for obtaining a command value αA. The command value αA is set to be "0" where the difference load ΔF is out of the predetermined load range, whereas the command value αA is set to be "A" where the difference load ΔF falls in the predetermined load range.

Further, the command value calculating part 312 is configured to multiply the second command value B by the second multiplying ratio β for obtaining a command value βB. The command value βB is set to be "B" where the difference load ΔF is out of the predetermined load range, whereas the command value βB is set to be "0" where the difference load ΔF falls in the predetermined load range.

Yet further, the command value calculating part 312 is configured to calculate sum of the command value αA and the command value βB obtained in Step S12. The sum of the command value αA and the command value βB is set to be "the first command value A" where the difference load ΔF falls in the predetermined load range, whereas the sum of the command value αA and the command value βB is set to be "the second command value B" where the difference load ΔF is out of the predetermined load range.

The lift controlling part 313 is configured to output either the first command value A or the second command value B to the proportional control valve 230, whereas the proportional control valve 230 is configured to supply the hydraulic oil to the lift cylinder 50. When the blade load M is herein out of a predetermined load range (i.e., M<N−0.05 W or M>N+0.1 W), the blade lifting angle θb is regulated for allowing the blade load M to fall in the predetermined load range (i.e., N−0.05 W≤M≤N+0.1 W). When the blade load M herein falls in the predetermined load range (i.e., N−0.05 W≤M≤N+0.1 W), on the other hand, the blade lifting angle θb is regulated for allowing the sum of the forwardly inclined angle θa and the blade lifting angle θb (i.e., the blade angle θc) to fall in a predetermined angular range (i.e., θx−2 degrees≤θc≤θx+2 degrees).

Actions of Blade Controller 210

Figure 11:
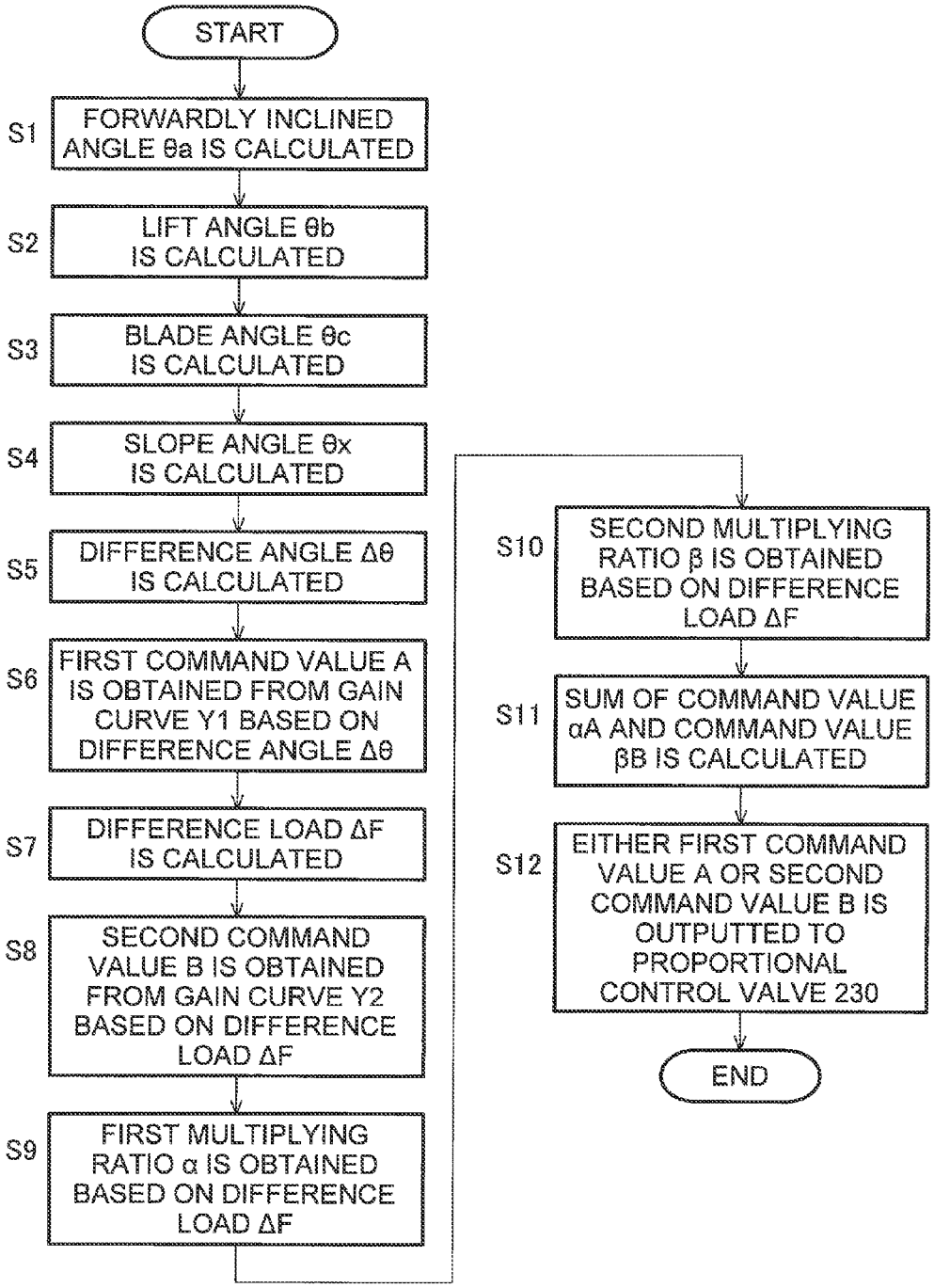
FIG. 11 is a flowchart for explaining actions of the blade controller.

FIG. 11 is a flowchart for explaining actions of the blade controller 210.

First in Step S1, the blade controller 210 calculates the forwardly inclined angle θa of the vehicle body 10 with respect to the reference surface S based on the vehicle body inclined angle data obtained from the IMU 60.

Next in Step S2, the blade controller 210 calculates the blade lifting angle θb of the blade 40 based on the lift cylinder length L obtained from the lift cylinder sensor 51.

Next in Step S3, the blade controller 210 calculates the sum of the forwardly inclined angle θa and the blade lifting angle θb (i.e., the blade angle θc).

Next in Step S4, the blade controller 210 calculates the slope angle θx of the designed surface T with respect to the reference surface S.

Next in Step S5, the blade controller 210 calculates the difference angle Δθ between the blade angle θc and the slope angle θx.

Next in Step S6, the blade controller 210 obtains the first command value A (the elevating command value or the lowering command value) based on the difference angle Δθ with reference to the gain curve Y1 represented in FIG. 7.

Next in Step S7, the blade controller 210 calculates the difference load ΔF between the blade load M and the target blade load N.

Next in Step S8, the blade controller 210 obtains the second command value B (the elevating command value or the lowering command value) based on the difference load ΔF with reference to the gain curve Y2 represented in FIG. 8.

Next in Step S9, the blade controller 210 obtains the first multiplying ratio a based on the difference load ΔF with reference to the multiplying ratio curve G1 represented in FIG. 9.

Next in Step S10, the blade controller 210 obtains the second multiplying ratio β based on the difference load ΔF with reference to the multiplying ratio curve G2 represented in FIG. 10.

Next in Step S11, the blade controller 210 obtains the command value αA by multiplying the first command value A by the first multiplying ratio α, and obtains the command value βB by multiplying the second command value B by the second multiplying ratio β. The command value αA is herein set to be "0" where the difference load ΔF is out of a predetermined load range, whereas the command value αA is set to be "A" where the difference load ΔF falls in the predetermined load range. On the other hand, the command value βB is set to be "B" when the difference load ΔF is out of a predetermined load range, whereas the command value βB is set to be "0" where the difference load ΔF falls in the predetermined load range. Further, the blade controller 210 calculates the sum of the command value αA and the command value βB. The sum of the command value αA and the command value βB is set to be "the first command value A" where the difference load ΔF falls in a predetermined load range, whereas the sum of the command value αA and the command value βB is set to be "the second command value B" where the difference load ΔF is out of the predetermined load range.

Next in Step S12, the blade controller 210 outputs the value obtained in Step S11 (i.e., the first command value A or the second command value B) to the proportional control valve 230.

Working Effects

According to the present exemplary embodiment, the blade controller 210 is configured to regulate the blade lifting angle θb for allowing the blade load M to fall in a predetermined load range (i.e., N−0.05 W≤M≤N+0.1 W) when the blade load M is out of the predetermined load range (i.e., M<N 0.05 W or M>N+0.1 W). Also, the blade controller 210 is configured to regulate the blade lifting angle θb for allowing the blade angle θc to fall in a predetermined angular range including the slope angle θx (i.e., θx−2 degrees≤θc≤θx+2 degrees) when the blade load M falls in the predetermined load range.

Therefore, it is possible to move the cutting edge 40P of the blade 40 along the designed surface T when the blade load M is kept roughly close to the target blade load N, thereby the dozed surface is thereby prevented from being formed in a wavy contour. On the other hand, the blade load M can be promptly regulated to get closer to the target blade load N when the blade load M is deviated from the target blade load N, thereby dozing can be thereby efficiently executed.

Other Exemplary Embodiments

An exemplary embodiment of the present invention has been explained above, but the present invention is not limited to the aforementioned exemplary embodiment, and a variety of changes can be herein made without departing from the scope of the present invention.

(A) A variety of numeric values, specified for e.g., the predetermined load range and the predetermined angular range in the aforementioned exemplary embodiment, are exemplary only and may be arbitrarily set.

(B) In the aforementioned exemplary embodiment, the actions of the blade control system 200 have been explained using examples of a variety of curves in FIGS. 7 to 10, but the profiles of the curves are not limited to the above and may be arbitrarily set.

(C) Although not particularly described above, a designed surface U, which has a slope angle θy (≠ the slope angle θx) with respect to the reference surface S, may be continued to the designed surface T. In this case, it is preferable to use a time varying angle θz which is calculated by the following equation (1) instead of the slope angle θx used in Step S4 of FIG. 11.

$$\theta z = \text{slope angle } \theta x + (\text{slope angle } \theta y - \text{slope angle } \theta x) \times \text{elapsed time/predetermined period of time} \quad (1)$$

Accordingly, the blade lifting angle θb gradually gets closer to the slope angle θy in accordance with an elapsed time when a target contour of an object for dozing is changed from the designed surface T to the designed surface U. Thus, the dozed surface can be inhibited from being roughened due to abrupt change of the blade lifting angle θb, thereby the boundary between two dozed surfaces and its periphery can be inhibited from being formed in a wavy contour.

(D) In the aforementioned exemplary embodiment, the blade load is configured to be calculated based on the driving torque data, but the calculation method of the blade load is not limited to the above. For example, the blade load can be obtained by multiplying engine torque by a sprocket wheel diameter and a reduction ratio of a transmission, a steering mechanism and a final reduction gear mechanism.

(E) In the aforementioned exemplary embodiment, the bulldozer has been explained as an exemplary "construction machine", but the construction machine is not limited to a bulldozer, and may be any suitable construction machines such as a motor grader.

Description of the Numerals

10 . . . vehicle body, 11 . . . cab, 12 . . . engine compartment, 20 . . . drive unit, 30 . . . lift frame, 31 . . . ball-and-socket joint, 40 . . . blade, 41 . . . universal coupling, 50 . . . lift cylinder, 51 . . . lift cylinder sensor, 60 . . . IMU, 70 . . . pair of sprocket wheels, 80 . . . driving torque sensor, 100 . . . bulldozer, 200 . . . blade control system, 210 . . . blade controller, 220 . . . rotation speed sensor, 230 . . . blade control executing button, 240 . . . hydraulic pump, L . . . lift cylinder length, θa . . . inclined angle, θb . . . blade lifting angle, θc . . . blade angle, θx . . . slope angle, Δθ. . . difference angle, M . . . blade load, J . . . starting point, K . . . dozed slope, L . . . lift cylinder length, M . . . blade load, N . . . target blade load, ΔF . . . difference load, S . . . reference surface, T . . . designed surface, W . . . vehicle weight of the bulldozer 100

What is claimed is:

1. A blade control system, comprising:

a lift frame vertically pivotably attached to a vehicle body;

a blade attached to a tip of the lift frame;

a lift cylinder configured to vertically drive the lift frame;

a control valve configured to supply a hydraulic oil to the lift cylinder;

a blade angle calculating part configured to calculate a blade angle which is sum of a forwardly inclined angle of the vehicle body with respect to a reference surface and a blade lifting angle of the lift frame with respect to a reference position;

a slope angle obtaining part configured to calculate a slope angle of a designed surface with respect to the reference surface, the designed surface indicating a target contour of an object for dozing;

a difference angle calculating part configured to calculate a difference angle between the blade angle and the slope angle;

a first open ratio setting part configured to set a first open ratio of the control valve based on the difference angle;

a blade load obtaining part configured to obtain a blade load acting on the blade;

a difference load calculating part configured to calculate a difference load between the blade load and a target blade load;

a second open ratio setting part configured to set a second open ratio of the control valve based on the difference load; and a lift controlling part configured to control the control valve based on the second open ratio when the blade load is out of a predetermined load range, and the lift controlling part configured to control the control valve in accordance with the first open ratio when the blade load is within the predetermined load range.

2. The blade control system according to claim 1, wherein, when dozing is continuously executed from the designed surface to another designed surface continued to the designed surface, the lift controlling part is configured to regulate the blade lifting angle for allowing the sum to gradually get closer to a slope angle of said another designed surface with respect to the reference surface.

3. A construction machine, comprising:

a vehicle body; and the blade control system according to claim 1.

4. The construction machine according to claim 3, further comprising:

a drive unit including a pair of tracks attached to the vehicle body.

5. A blade control method performed by a blade control system including a lift frame vertically pivotably attached to a vehicle body, a blade attached to a tip of the lift frame, a lift cylinder configured to vertically drive the lift frame, and a control valve configured to supply a hydraulic oil to the lift cylinder, the blade control method comprising:

regulating a blade lifting angle of the lift frame with respect to a reference position, by controlling the control valve, for allowing a blade load acting on a blade attached a tip of the lift frame to fall in a predetermined load range when the blade load is out of the predetermined load range; and regulating the blade lifting angle, by controlling the control valve, for allowing sum of the blade lifting angle and a forwardly inclined angle of the vehicle body with respect to a reference surface to fall in a predetermined angular range including a slope angle of a designed surface indicating a target contour of an object for dozing with respect to the reference surface when the blade load is within the predetermined load range.

* * * * *